US005785610A

United States Patent [19]

Birmingham

[11] Patent Number: 5,785,610

[45] Date of Patent: Jul. 28, 1998

[54] CLUBHEAD FOR GOLF CLUB

[75] Inventor: John Birmingham, Houston, Tex.

[73] Assignee: Premier Golf, Inc., Houston, Tex.

[21] Appl. No.: 561,294

[22] Filed: Nov. 21, 1995

[51] Int. Cl.[6] ..... A63B 53/04

[52] U.S. Cl. ..... 473/331

[58] Field of Search ..... 473/330, 331, 473/324

[56] References Cited

U.S. PATENT DOCUMENTS

| | | | |
|---|---|---|---|
| D. 55,278 | 5/1920 | Kraeuter | 473/331 X |
| D. 193,098 | 6/1962 | Davis | 473/331 X |
| D. 210,033 | 1/1968 | Johnston | 473/331 X |
| 1,337,958 | 4/1920 | Reach | 473/331 |
| 1,511,479 | 10/1924 | Kelly | 473/330 |
| 1,965,954 | 7/1934 | Davis | 473/331 X |
| 2,005,401 | 6/1935 | Storz | 473/331 |
| 2,034,936 | 3/1936 | Barnhart | 473/331 X |
| 5,354,059 | 10/1994 | Stuff | 473/331 X |

*Primary Examiner*—Sebastiano Passaniti
*Attorney, Agent, or Firm*—Jennifer S. Sickler; Brown McCarroll & Oaks Hartline

[57] ABSTRACT

A new clubhead having a plurality of grooves extending between defined boundaries on the face surface of the clubhead has been developed. In one embodiment, two groups of grooves are arranged to only intersect at a vertical boundary that intersects the center of the sweet spot on the face surface to form a chevron pattern within the define boundaries. In an alternate embodiment, the two groups of grooves traverse fully across the defined grooved area of the face surface to intersect to form a plurality of parallelogram-shaped areas within the grooved area.

14 Claims, 2 Drawing Sheets

CLUBHEAD FOR GOLF CLUB

BACKGROUND OF THE INVENTION

1. Technical Field

This invention relates generally to a golf clubhead, and more particularly to golf clubheads having a grooved surface on the face of the clubhead.

2. Background Art

Grooved face surfaces on golf clubheads have been used heretofore to provide greater "bite" between the face surface and a ball to hopefully improve a golfer's control of the subsequent flight path of the ball. Grooves in the face surface of a golf clubhead generally improve the surface contact between the face of the clubhead and the ball and is an important aid to imparting spin on the golf ball.

The spin direction and rotational spin rate of the ball influences both the direction and distance of the ball's flight and roll. Also, it is well known that striking the ball toward the toe end of the clubhead will generally cause the flight of the ball to slice, or deviate in the direction of the dominant hand of the player, i.e., curve to the right for a right-handed golfer. Similarly, striking the ball toward the heel end of the clubhead will generally result in the ball hooking, or curving in the direction opposite to the dominant hand of the player, i.e., curve to the left for a right-handed golfer.

The present invention is directed to improving the ball flight control characteristics of a golf clubhead. It is desirable to have a golf clubhead with an optimized arrangement of grooves in the face surface that provides improved surface contact and dynamic interaction with the ball. It is also desirable to have such a clubhead in which the grooved surface area of the clubhead advantageously diminishes the curved flight deviation of the ball when hit off center, whether it be a slice or a hook.

SUMMARY OF THE INVENTION

In accordance with one aspect of the present invention, a clubhead for a golf club has a face surface and toe, heel and sole portions. The face surface has a grooved area disposed between a first boundary adjacent the toe portion and a second boundary adjacent the heel portion, each boundary being oriented on either side of the center of a sweet spot, which is a spot on the face of the club that is also on a centerline intersecting the center of gravity of the clubhead. This centerline also intersects a vertical boundary line on the face of the clubhead at the sweet spot. The grooved area has first and second groups of grooves that, within each group, are arranged in a parallel, equidistantly spaced apart relationship. The first group of grooves extends from the first boundary, and at least a part of the sole portion, in an upwardly direction away from the sole portion. The second group of grooves extend from the second boundary, and at least a part of the sole portion, in an upwardly direction away from the sole portion.

In one particular embodiment of the present invention, the first and second groups of grooves extend only to the vertical boundary of the face surface, whereupon they intersect and thereby form a chevron pattern of grooves. In another embodiment of the present invention, the first and second groups of grooves extend fully across the face surface, with the respective grooves of the first and second groups intersecting with each other at an included angle of between about 60° and about 175°, thereby forming a plurality of uniformly spaced apart parallelogram-shaped surfaces within the defined grooved surface area.

Still other objects, features and advantages of the present invention will be apparent from the following description of the preferred embodiments given for the purpose of disclosure and taken in conjunction with the accompanying drawings.

DETAILED DESCRIPTION OF THE INVENTION

Figure 1:
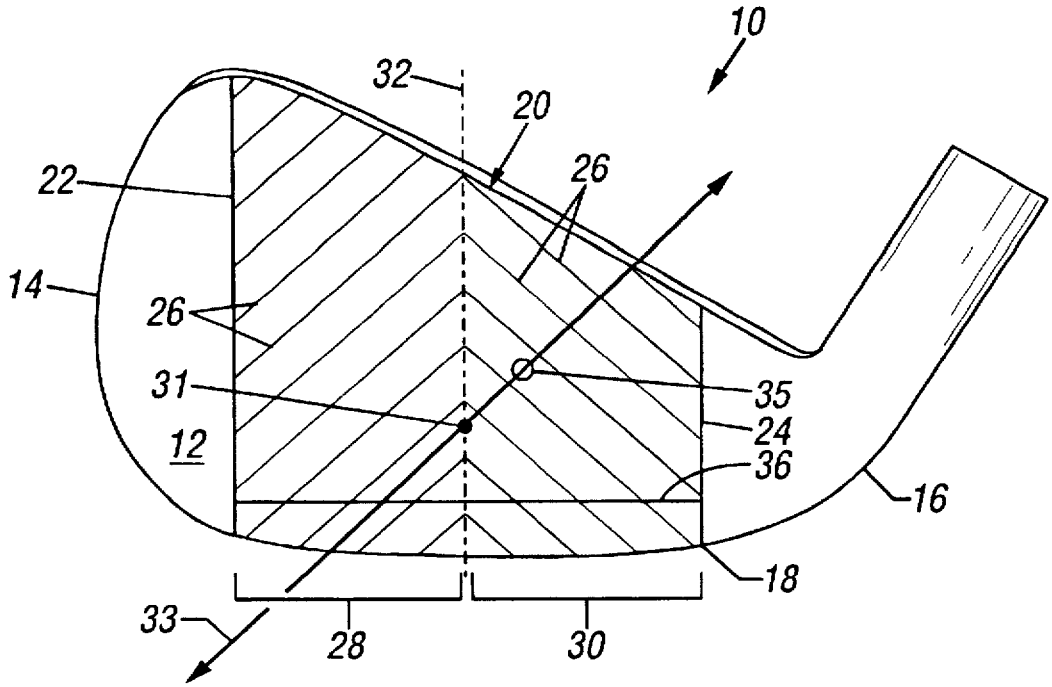
FIG. 1 is an elevational view of a preferred embodiment of the golf clubhead of the present invention.

As shown in the drawings, a golf clubhead 10 embodying the preferred embodiments of the present invention has a face surface 12, a toe portion 14, a heel portion 16, and a sole portion 18. The face surface 12 has a grooved area 20 that is disposed between a first boundary 22 adjacent the toe portion 14, and a second boundary 24 adjacent the heel portion 16. Importantly, the grooved area 20 comprises a plurality of grooves 26 arranged in two groups 28, 30 of equidistantly spaced apart parallel grooves 26. Golf clubs are well-known sports equipment, and the present invention may be used with any golf club. One skilled in the art would readily know how to construct a golf clubhead with a face surface, a toe, a heel, a sole, a back, and a top, in any number of configurations, such that the clubhead face of any club could properly incorporate the invention described in this application.

In the preferred embodiment of the present invention shown in FIG. 1, the first group of grooves 28 extends from the first boundary 22 and from part of the sole portion 18 in a direction generally upward direction from the sole portion 18, and the second group of parallel grooves 30 extends from the second boundary 24 and from a part of the sole portion 18 in a generally upward direction from the sole portion 18. The grooves 26 of each of the groups 28, 30 are aligned so that they intersect with each other at a vertical boundary 32 and form a chevron pattern of grooves 26. The vertical boundary 32 passes through the center of the sweet spot 31 on the face surface 12 and also intersects a centerline 33 that passes through the center of gravity 35 of the clubhead 10. This arrangement is particularly desirable for a clubhead 10 on the long clubs, or drivers; for example, the United States Golf Association (USGA) numbered clubs 1 through 7. Preferably, the intersecting grooves 26 have an included angle $\beta$, as shown in FIG. 2, of from about 60° to about 175°.

Figure 2:
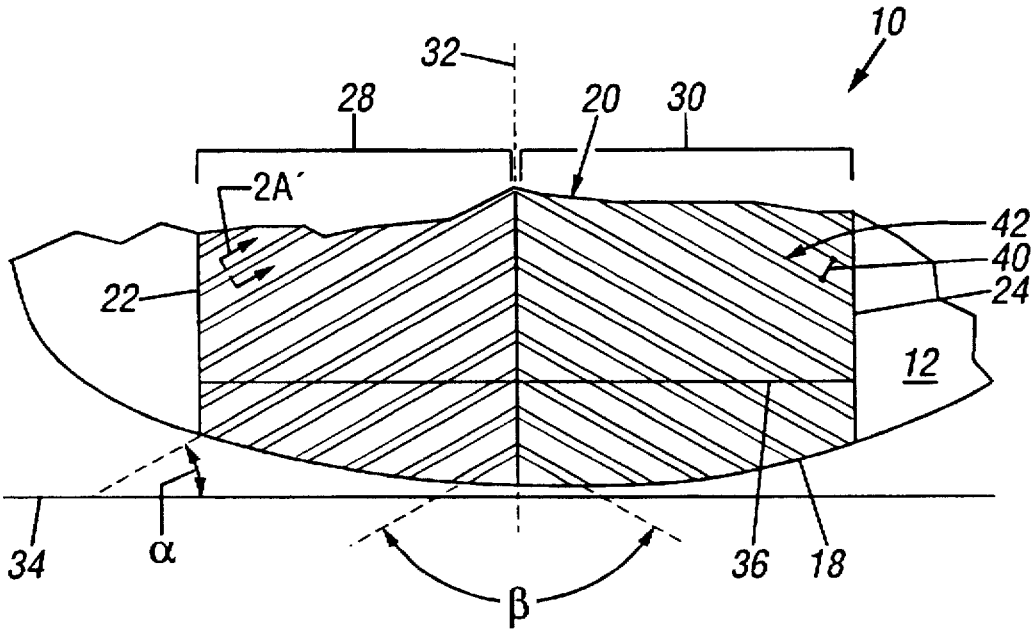
FIG. 2 is an enlarged view of a portion of the golf clubhead illustrated in FIG. 1, showing details of the angular orientation of grooves disposed in the face surface of the clubhead.

As shown in FIG. 2, the disposition of the grooves 26 may also be described in terms of their degree of anglea from a horizontal reference line 34 perpendicular to the vertical boundary 32. The grooves 26 have an angle a of from about 2.5° to about 60°, and preferably about 45°, from the horizontal reference line 34. The actual angles $\alpha,\beta$ of the grooves may be varied within the above described ranges to accommodate individual stroke characteristics. If a golfer has a pronounced tendency to slice the ball, the groove angle α a is preferably adjusted to a value greater than 45°. For a golfer with little or no slice tendencies, the clubhead 10 is preferably made with a groove angle α a less than 45°, and more preferably in the range of from about 2.5° to 30°. Moreover, depending on a particular golfer's needs, an alternate embodiment of the clubhead 10 may be used which has an angle α a with one value applied to the first group of grooves 28, and a different value for the second group of grooves 30.

When the ball is hit near the center of the sweet spot 31 of the clubhead 10, the diverging grooves 26 of the chevron pattern (downward and away from vertical boundary 32) help negate side spin and improve rollover, or backspin. If desired, a conventional shallow, decoratively colored, horizontal sight line 36 may be provided in the grooved area 20 of the face surface 12 as an aid to proper alignment of the clubhead 10 with the ball.

Figure 2A:
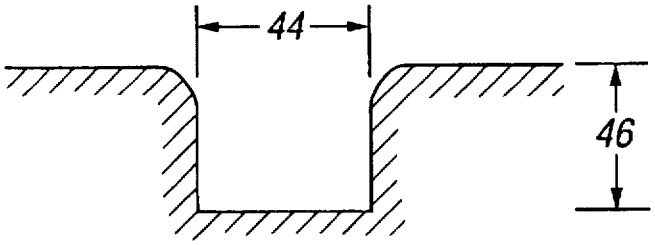
FIG. 2A is an end view of the embodiment of the golf clubhead of FIG. 2 taken along the line 2A'—2A', showing a cross-section of a groove.

As further shown in FIG. 2 and FIG. 2A, each of the grooves 26 are preferably straight along their length and uniform in cross-section. The cross-section of the grooves preferably is a V-shape, a U-shape, a trapezoidal-shape, or has a square or rounded bottom with either straight or angled sidewalls. Examples of suitable cross-sectional shapes are illustrated in USGA Rule 4-le(i), which is incorporated herein fully by reference. In accordance with the USGA Rules, metallic clubs of the present invention having a loft angle of less than 24 degrees preferably have grooves 26 with widths 44 that do not exceed 0.035 in. (0.9 mm), using the 30 degree method of measurement established by the USGA and illustrated in the Rule. Further, the depth 46 of such grooves 26 preferably does not exceed 0.020 in. (0.5 mm). In addition, the distance or spacing 40, between edges 42 of adjacent grooves 26 should not exceed 0.075 in. (1.9 mm). Sharp edges along the edges 42 of the grooves 26 are not permitted by the USGA, so the edges 42 of the grooves 26 of the present invention are preferably slightly rounded, such that the radius of curvature of the rounded edge 42 does exceed 0.020 in. (0.5 mm). Non-metallic clubs with a loft or face angle exceeding 24 degrees preferably have grooves 26 with a width 44 of up to 0.040 in. (1.0 mm), and a groove depth 46 of up to as deep as 1 ½ times the groove width 44. The above groove 26 dimensions are preferred dimensions due to the USGA Rules, it being recognized that rules may be changed, modified or amended, and that the grooves 26 comprising the present invention are not limited to the specific dimensions permitted under the present USGA Rules.

In one embodiment of the present invention, the spacing 40 between the grooves 26 progressively decreases as the loft of the club increases (or as the USGA defined club numbers increase). The grooves 26 preferably have a spacing 40 of 0.25 in. (6.35 mm) on a No. 1 driver and only 0.075 in. (1.9 mm) on the No. 15 club. In an embodiment of the invention where the progressive decrease in groove spacing 40 is uniform, the groove spacing 40 for a particular club preferably is calculated as follows:

$$S_{in}=0.0625+0.0125\ C_N; \quad (1)$$

$$S_{mm}=1.58+0.318\ C_N; \quad (2)$$

where $S_{in}$ is the spacing 40 between grooves 26 in inches, $S_{mm}$ is the spacing 40 between groove 26 in millimeters, and $C_N$ is the USGA defined club number.

Alternatively, the groove spacings 40 may be increased incrementally for groups of clubs. In one embodiment, clubs 1 to 3 have a groove spacing 40 of 0.25 in. (6.35 mm); clubs 4 to 6 have a groove spacing 40 of 0.20 in. (5.0 mm); clubs 7 to 9 have a groove spacing 40 of 0.15 in. (3.8 mm); clubs 10 to 12 have a groove spacing 40 of 0.10 in. (2.5 mm); and clubs 13 to 15 have a groove spacing 40 of 0.075 in. (1.9) mm.

The above examples are given for the purpose of illustrating the above embodiments of the present invention. The actual groove angle α and the groove spacing 40, or density of grooves 26, within the grooved area 20 of the face surface 12 may be advantageously adjusted, or modified, to best fit the particular needs and swing characteristics of a selected golfer.

Figure 3:
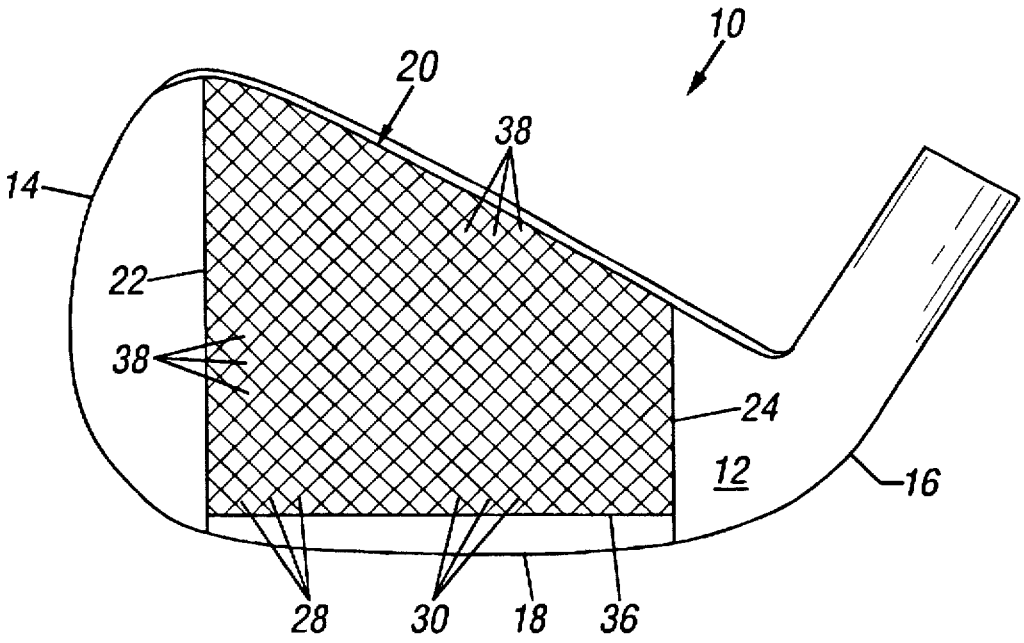
FIG. 3 is an elevational view of an alternative preferred embodiment of the golf clubhead of the present invention.

In another embodiment of the present invention, shown in FIG. 3, both the first and second groups of grooves 28,30 extend completely across the grooved area 20 of the face surface 12. In this arrangement, each of the grooves 26 in the first group 28 intersect multiple grooves 26 of the second group 30, forming a plurality of parallelogram, or diamond-shaped, surfaces 38 within the grooved area 20. This arrangement provides increased grooved area 20 surface contact with the ball for better contact with the ball. This embodiment is particularly preferred for the shorter clubs, e.g., the clubs numbered 8 and up, and for wedges.

Although the present invention is described in terms of illustrative embodiments, those skilled in the art will recognize that changes in groove shape, width, depth, spacing and angular orientation with a horizontal reference line may be made without departing from the spirit of the invention. Such changes are intended to fall within the scope of the following claims. Other aspects, features and advantages of the present invention can be obtained from a study of this disclosure along with the appended claims.

I claim:

1. A clubhead for a golf club, which comprises:

a toe portion;

a heel portion;

a sole portion; and a face surface having a grooved area disposed between a first boundary adjacent said toe portion and a second boundary adjacent said heel portion, each boundary being oriented on either side of a center of a sweet spot, said grooved area being traversed by a first group of parallel grooves equidistantly spaced apart from each other and extending from said first boundary and at least a part of said sole portion in a generally upward direction from said sole portion, and being traversed by a second group of parallel equidistantly spaced apart grooves extending from said second boundary and at least a part of said sole portion in a generally upward direction from said sole portion, the grooves of the first group and second group aligned to intersect with each other at a vertical boundary that passes through the center of the sweet spot.

2. A clubhead for a golf club, as set forth in claim 1, wherein said first group of parallel equidistantly spaced apart grooves and said second group of parallel equidistantly spaced apart grooves are disposed so that the grooves in each of the first and second groups intersect with each other and form a chevron pattern of grooves.

3. A clubhead for a golf club, as set forth in claim 2, wherein the included angle between the intersecting grooves of said first and second groups of parallel equidistantly spaced apart grooves is from about 60° to about 175°.

4. A clubhead for a golf club, as set forth in claim 2, wherein each of said grooves in said first and second groups of parallel equidistantly spaced apart grooves is disposed at an angle of from about 2.5° to about 60° to a horizontal reference line that is perpendicular to the first and second boundaries.

5. A clubhead for a golf club, as set forth in claim 1, wherein each of said grooves in said first and second groups of parallel equidistantly spaced apart grooves is disposed at an angle of from about 2.5° to about 60° to a horizontal reference line that is perpendicular to the first and second boundaries.

6. A clubhead for a golf club, as set forth in claim 1, wherein the grooves of said first and second groups of parallel equidistantly spaced apart grooves extend from the first and second boundaries and from said sole portion in a generally upward direction away from said sole portion and fully traverse said face surface, said grooves of the first and second groups intersecting at an included angle of from about 60° to about 175°, thereby forming a plurality of uniformly spaced apart parallelogram-shaped surfaces within said grooved area.

7. A clubhead for a golf club, as set forth in claim 1, wherein the spacing between the grooves in each of said first and second groups of parallel equidistantly spaced apart grooves is from about 0.075 in. (1.9 mm) to about 0.25 in. (6.35 mm).

8. A clubhead for a golf club, as set forth in claim 5, wherein the angle is a value in the range of about 46° to about 60°.

9. A clubhead for a golf club, as set forth in claim 5, wherein the angle is a value in the range of about 2.5° to about 30°.

10. A clubhead for a golf club, as set forth in claim 5, wherein the first group of parallel equidistantly spaced apart grooves is disposed at an angle to the horizontal reference line that is different from the angle of the second group of parallel equidistantly spaced apart grooves to the horizontal reference line.

11. A clubhead for a golf club, as set forth in claim 1, wherein the equidistant spacing between the parallel grooves is determined by the equation:

$$S_{in}=0.0625+0.0125\ C_n$$

12. A clubhead for a golf club, as set forth in claim 1, wherein the equidistant spacing between the parallel grooves is determined by the equation:

$$S_{mm}=1.58+0.318C_n$$

13. A clubhead for a golf club, as set forth in claim 1, wherein the equidistant spacing between the parallel groves is decreased incrementally for groups of clubs as a loft of a club increases.

14. A clubhead for a golf club, as set forth in claim 13, wherein the equidistant spacing between the parallel grooves is about 0.25 inch for clubs 1 to 3, about 0.20 inch for clubs 4 to 6, about 0.15 inch for clubs 7 to 9, about 0.10 inch for clubs 10 to 12, and about 0.075 inch for clubs 13 to 15.

* * * * *